US007007532B2

(12) United States Patent
Singer et al.

(10) Patent No.: US 7,007,532 B2
(45) Date of Patent: Mar. 7, 2006

(54) PROCESS FOR THE PRODUCTION OF TUBULAR STRUCTURAL PARTS FABRICATED FROM PGM MATERIALS AND HAVING CIRCUMFERENTIAL UNDULATING BULGES

(75) Inventors: Rudolf Singer, Engelstadt (DE); Hubertus Gölitzer, Alzenau (DE)

(73) Assignee: Umicore AG & Co. KG, Hanau (DE)

( * ) Notice: Subject to any disclaimer, the term of this patent is extended or adjusted under 35 U.S.C. 154(b) by 459 days.

(21) Appl. No.: 09/978,792

(22) Filed: Oct. 18, 2001

(65) Prior Publication Data

US 2002/0046586 A1 Apr. 25, 2002

(30) Foreign Application Priority Data

Oct. 19, 2000 (DE) ..... 100 51 946

(51) Int. Cl.
*B21D 15/10* (2006.01)

(52) U.S. Cl. ..... 72/59; 72/56

(58) Field of Classification Search ..... 72/54, 72/56, 59, 60

See application file for complete search history.

(56) References Cited

U.S. PATENT DOCUMENTS 349,718 A * 9/1886 Hollerith ..... 72/459
1,823,532 A * 9/1931 Clifford ..... 72/459
2,183,304 A * 12/1939 Davis ..... 72/459
2,919,740 A * 1/1960 Poitras ..... 72/459
3,015,354 A * 1/1962 Wood ..... 72/459
3,103,244 A * 9/1963 Schindler et al. ..... 72/459
3,625,040 A 12/1971 De Gain
3,704,983 A * 12/1972 Tellot ..... 72/459

FOREIGN PATENT DOCUMENTS

DE 17 77 181 3/1971

OTHER PUBLICATIONS

Copy of German Office Action (German language) in counterpart appln. No. 100 51 946.6-14, dated Mar. 12, 2001.

* cited by examiner

*Primary Examiner*—David Jones
(74) *Attorney, Agent, or Firm*—Kalow & Springut LLP

(57) ABSTRACT

A process for the production of tubular structural parts fabricated from PGM materials and having circumferential undulating bulges by forming from smooth-walled tube pieces. A smooth-walled tube piece (1) is inserted into a cylindrical forming die (2) with an internal diameter that corresponds substantially to the external diameter of the tube piece and that has radial undulating recesses (3). This die is provided at both axial ends with a press tool (4,5) that tightly seals the tube ends. The space that is thus formed is completely filled with an hydraulic fluid (6), and an hydraulic internal pressure is then produced by exerting an axial compression via the press tools (4,5) in such a way that under simultaneous shortening of the tube piece bulges (7) are formed in the wall of the latter that correspond to the recesses (3) of the forming die (2).

18 Claims, 3 Drawing Sheets

PROCESS FOR THE PRODUCTION OF TUBULAR STRUCTURAL PARTS FABRICATED FROM PGM MATERIALS AND HAVING CIRCUMFERENTIAL UNDULATING BULGES

INTRODUCTION AND BACKGROUND

The present invention relates to a process for the production of tubular structural parts fabricated from PGM materials and having circumferential undulating bulges by forming from smooth-walled tube pieces.

Structural parts fabricated from precious metal materials, such as preferably PGM materials, are used in the glass industry, in particular in plants for the fusion and hot forming of special glasses.

On account of their high melting point, materials of PGM metals (platinum group metals) are characterised by a high thermal resistance and also by high mechanical strength and resistance to abrasion, and are therefore particularly suitable for the production of structural parts in plants or plant units that come into contact with glass melts. Suitable materials are platinum and alloys of platinum and/or other PGM metals, which may optionally also contain minor amounts of non-precious metals as further alloying components or oxide additives. Typical materials are refined platinum, PtRh10 (platinum-rhodium alloy with 10% rhodium) or platinum, which contains a small amount of finely divided refractory metal oxide, such as in particular zirconium oxide (so-called fine grain-stabilized platinum), in order to improve the mechanical strength and high-temperature creep resistance.

Such melt technology plant components serve for the fusion, refining, transportation, homogenization and charging of the molten glass.

Such structural parts are substantially precious metal sheet-type constructions that are often fabricated as thin-walled tubular systems. The molten glass flows through such systems at temperatures of between 1000° C. and 1700° C. These tubular systems are as a rule surrounded by an insulating as well as supporting ceramic material, which in turn is frequently held by supporting metal structures such as metal boxes.

The PGM structural parts are fabricated at room temperature and installed in the corresponding units. However, the units are operated at temperatures in the range from about 1000° to 1700° C.

Thin-walled sheet metal structures have only a low dimensional rigidity, in particular at high operating temperatures. In order to compensate for this disadvantage the material thickness must either be increased or the structure must be stabilized by stiffening forming measures such as for example the formation of bends, edges, corrugations or folds.

Furthermore, when designing and building corresponding units the high thermal expansion of the PGM structural parts as well as the different thermal expansion of all the other materials involved (precious metals, ceramics, steels, etc.) must be taken into account. The mean coefficient of thermal expansion of platinum at a temperature of 1500° C. is $11.2\times10^{-6}\ K^{-1}$. This means that a platinum structural part that is one meter long at room temperature has expanded by 16.6 millimeters at 1500° C.

Due to the different coefficients of thermal expansion of the various materials and structural securement points present on a structural part, a free expansion of the system is not possible. Accordingly bending or even buckling may occur at weak points in PGM sheet structures, and this in turn leads to the undesired premature failure of the system. In plants or parts of plants fabricated from PGM materials that come into contact with the glass melt, structural parts therefore have to be provided that compensate for the linear expansion.

Tubular sections that have circumferential undulating bulges, such as for example corrugated tubes or bellows, may be used as structural elements in tubular plant parts to impart a radial stiffening and to a certain extent also to compensate for linear expansion.

The forming of corresponding smooth-walled tube pieces into corrugated tubes is carried out according to the prior art by so-called roll crimping or roll forming. In this, the wall of the smooth-walled tube piece is forced out by a curling tool acting from the inside, into the radial corrugated recess of a forming die. In roll crimping each individual corrugation is rolled successively step by step.

A tube formed in this way and thus stiffened in the radial direction becomes more elastic in the axial direction and can therefore also be used for length compensation.

Roll crimping has however—specifically with regard to the production of corrugated structural parts from PGM materials for use in melt technology plants in the glass industry—a number of disadvantages and limits on potential use.

Thus, only relatively small shape alterations, for example in the region of sinusoidal wave contours, can be effected by roll crimping. Higher corrugations peaks, sharper folds or even arbitrary contour shapes cannot be produced in practice. For this reason corrugated tubes produced by roll crimping are of only limited suitability for compensating thermal linear expansion since the corresponding corrugation geometries can compensate only for moderate linear expansions.

Furthermore, roll crimping is not possible with small tube diameters.

Due to the stretching of the material in roll crimping there is inevitably a thinning (reduction in wall thickness) in the region of the corrugations. The structural part is thus considerably weakened, which can lead to a premature failure under the thermal and abrasive stresses produced by contact with the glass melt.

An object of the invention is accordingly to provide structural parts of PGM materials for use as linear expansion compensators in units or parts of units coming into contact with the glass melt, and also to provide a production process for such structural parts in which the aforedescribed disadvantages are avoided.

SUMMARY OF THE INVENTION

The above and other objects of the invention can be achieved with a fabrication process in which the forming is effected by extrusion with hydraulic internal pressure.

The invention accordingly provides a process for the production of tubular structural parts fabricated from PGM materials and having circumferential undulating bulges, by forming from smooth-walled tube pieces, which is characterized in that a smooth-walled tube piece is inserted into a cylindrical forming die with an internal diameter that corresponds substantially to the external diameter of the tube piece and that has radial undulating recesses. This is provided at both axial ends with a press tool that tightly seals the tube ends, and the space that is thus formed is completely filled with a hydraulic fluid. A hydraulic internal pressure is then produced by exerting an axial compression via the press tools in such a way that under simultaneous shortening of the tube piece bulges are formed in the wall of the latter that correspond to the recesses of the forming die.

BRIEF DESCRIPTION OF DRAWINGS

The present invention will be further understood with reference to the accompanying drawings wherein.

DETAILED DESCRIPTION OF THE INVENTION

In the process according to the invention seamless or welded smooth-walled tube pieces of industrial PGM materials of circular or polygonal cross-section and of arbitrary radii can be used as initial workpieces. Refined platinum, PtRh10 or FKS platinum is preferably used as PGM materials. The forming of the tube piece is carried out in a forming unit by extrusion under an hydraulic internal pressure with simultaneous exertion of an axial compression on the tube ends. To this end the smooth-walled tube piece to be formed is inserted into a cylindrical forming die with an internal diameter that corresponds substantially to the external diameter of the tube piece and that has radial undulating recesses. Press tools are mounted on both axial tube ends that tightly seal the said tube ends. The space that is thus formed is then completely filled with an hydraulic fluid. Water or conventional hydraulic oils used in the art are preferably used as hydraulic fluids. For the actual forming process an axial compression is then exerted via the press tools on the tube ends, which move towards one another. In this way an hydraulic internal pressure acting on the tube walls is produced in the interior by means of the fluid, which forces the wall into the recesses of the forming tool, bulges corresponding to the extent of the shortening of the tube piece thereby being formed in the said tube piece.

Figure 1:
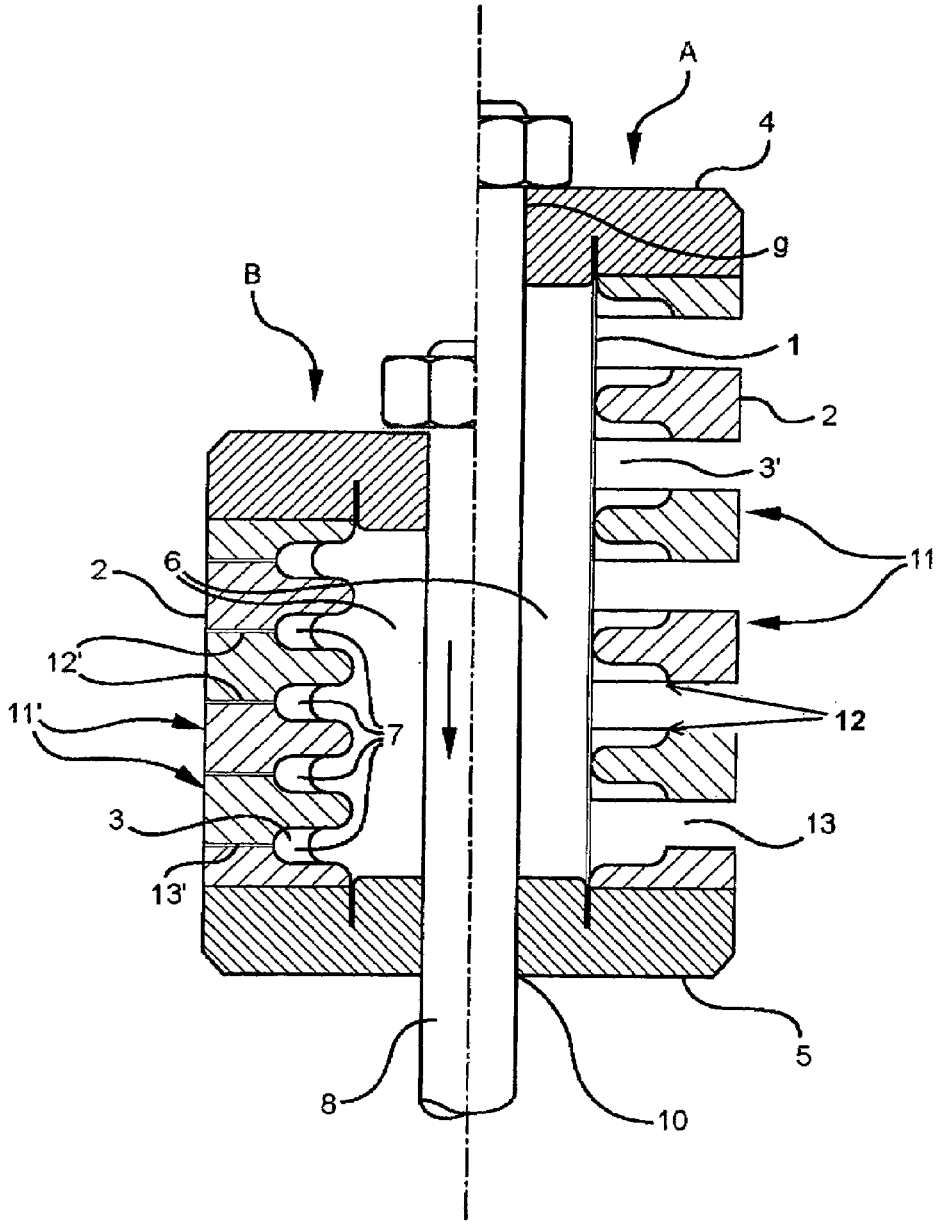
FIG. 1 is a schematic sectional view of a die used to carry out the process of this invention.

The process according to the invention is shown in FIG. 1 by way of example in a schematic representation and illustrates a preferred embodiment, the right-hand half (A) showing the initial state and the left-hand half (B) showing the state at the end of the forming process.

The smooth-walled initial tube piece (1) sits in a cylindrical forming die (2) having an internal diameter that corresponds substantially to the external diameter of the tube piece. The forming die (2) has radial undulating recesses (3, 3'). Press tools (4, 5) are mounted on the tube ends and tightly seal the internal space that is thus formed. The space formed by press tool (4, 5) and tube is completely filled with an hydraulic fluid (6). An axial compression is exerted via the press tools (4, 5), for example by the jaws of an hydraulic press (not shown). In this way the press tools (4, 5) and thus the tube ends are moved towards one another, whereby with simultaneous shortening of the tube piece bulges (7) corresponding to the recesses (3) of the forming die (2) are produced in the wall of the tube piece.

In a particular embodiment the axial compression is exerted by a drawbar (8) that is guided through central bores (9, 10) in the press tools (4, 5), and which forces the movably arranged press tool (4) towards the stationary press tool (5).

In a particularly preferred embodiment the cylindrical forming die (2) consists of formers (11) movably mounted in the axial direction, which in the initial state are arranged spaced apart from one another and which in the course of the axial compression are forced together (11'). With such a design of the forming tool it is particularly advantageous if the maximum heights of the undulating recesses (12, 12') are located in the region of the axial contact surfaces (13, 13') of the formers (11). The extrusion process is thereby promoted and the forming takes place smoothly and in a manner that protects the material.

By means of the process according to the invention corrugations of practically any desired shape can be produced in a single workstage, in particular using PGM materials, irrespective of the diameter and tube geometry of the initial tube piece.

Figure 2:
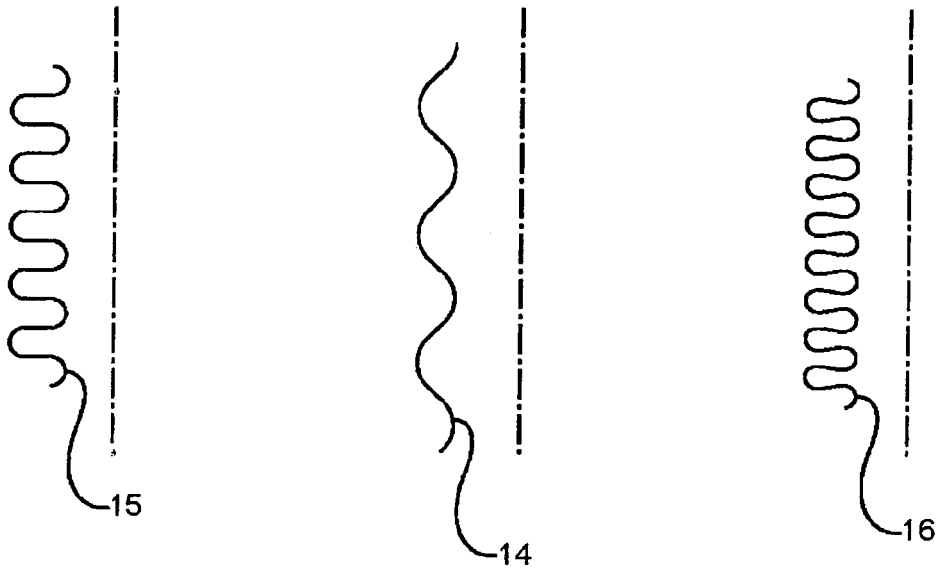
FIG. 2 is a schematic representation of several corrugation contours capable of being produced by the process of the present invention.

Typical corrugation contours are illustrated by way of example in FIG. 2. Flattish corrugations (14) are produced for example by a forming die whose recesses in radial section may have a substantially sinusoidal shape. Corrugations with higher peaks (15, 16) can be produced by forming dies whose recesses in radial section have a pronounced undulating contour or a lyre-shaped contour.

The particular advantage of the process according to the invention compared to roll crimping is that on the one hand substantially higher degrees of forming can be achieved, and on the other hand there are no or only slight differences in wall thickness inside and outside the corrugation profile. Thus, for example, a bellows of typical lyre shape produced from a PGM material by the process according to the invention has wall thickness differences of at most 10%. In the case of a moderately pronounced (roughly sinussoidal) corrugated tube, variations in wall thickness are at most 1%. Suitably formed structural parts are therefore substantially more stable and considerably more resistant to mechanical, thermal and abrasive stresses.

Tubular structural parts fabricated by the process according to the invention from PGM materials and having circumferential undulating bulges are thus particularly suitable as linear expansion compensators in units or parts of units that come into contact with glass melts. In this connection somewhat flat corrugated shapes (14; FIG. 2) are preferably used in cases where high radial dimensional stability and only a moderate thermal compensation for linear expansion are of primary importance. More pronounced corrugated shapes or lyre-shaped corrugation contours (15, 16; FIG. 2) are very elastic in the axial direction and may therefore be used in order to compensate relatively large linear expansions over a short length of the corrugated tube piece.

Corresponding structural parts may be used very advantageously as linear expansion compensators in plant parts controlling the glass melt, such as feed tubes and refining chambers, or in plant parts involved in conveying, homogenising or metering glass melts, such as stirrers, plungers and stirring units.

Figure 3:
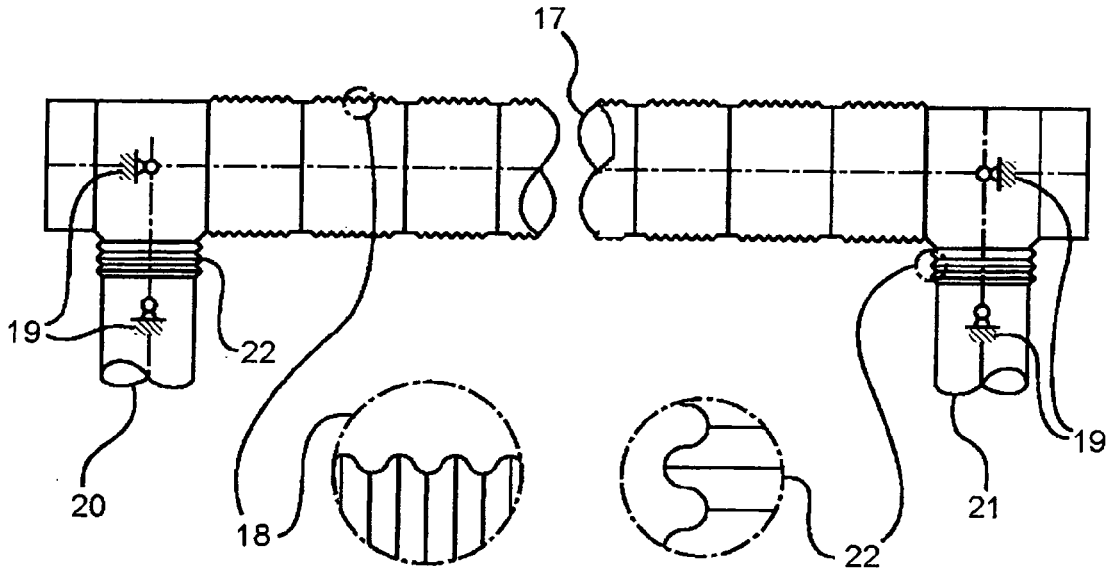
FIG. 3 illustrates the representative tube structure capable of being produced by the process of the present invention.

FIG. 3 shows by way of example and diagrammatically the construction of a tube of PGM material for a reduced pressure refining chamber (17). The tube of the refining section has segments with a corrugated profile (18) produced by the process according to the invention (section shown on an enlarged scale), which compensate the thermal linear expansion occurring between the securement points (19). The feed lines and discharge lines (20, 21) for the glass flow have corrugated regions of a different size (22) (section shown on an enlarged scale).

Further variations and modifications of the foregoing will be apparent to those skilled in the art and are intended to be encompassed by the claims appended hereto.

German priority application 100 51 946.6 of Oct. 19, 2000 is relied on and incorporated herein by reference.

We claim:

1. A process for the production of tubular structural parts fabricated from POM materials and having circumferential undulating bulges, said process comprising:

a) forming a tube piece having a smooth wall, two tube ends and an external diameter with a cylindrical forming die, said forming die comprising two axial ends, and a plurality of formers with radial undulating recesses, axial contact surfaces and an internal diameter, said formers being movably arranged in spaced apart relationship, and said forming die having at each end a press tool, b) inserting the smooth-walled tube piece into the cylindrical forming die with an internal diameter that corresponds substantially to the external diameter of the tube piece, c) sealing the tube ends with said press tool, and filling a space that is thus formed inside the tube piece completely with a hydraulic fluid, and d) producing a hydraulic internal pressure by exerting an axial compression by each press tool driving the formers of the forming die together in such a way that under simultaneous shortening of the tube piece bulges are formed in the wall of the tube piece that correspond to the recesses of the driven together formers of the forming die.

2. The process according to claim 1, wherein each press tool further comprises central bores and a drawbar, the central bores capable of guiding the drawbar, wherein axial compression is exerted by the drawbar that is guided through central bores in each press tool, and that forces one press tool that is movably arranged towards the other press tool which is stationary.

3. The process according to claim 1, wherein the tube piece is formed in a forming unit by extrusion and the forming die comprises a plurality of formers movably mourned in an axial direction, which in an initial state are arranged spaced apart from one another and which during axial compression are driven together.

4. The process according to claim 2, wherein the PGM material comprises platinum and the forming die comprises a plurality of formers movably mounted in an axial direction, which in an initial state are arranged spaced apart from one another and which during axial compression are driven together.

5. The process according to claim 3, wherein maximum heights of the undulating recesses are located in a region of the axial contact surfaces of the formers.

6. The process according to claim 4, wherein maximum heights of the undulating recesses are located in a region of the axial contact surfaces of the formers.

7. The process according to claim 1, wherein the undulating recesses of the forming die have a radial section that has a substantially sinusoidal contour.

8. The process according to claim 2, wherein the undulating recesses of the forming die have a radial section that has a substantially sinusoidal contour.

9. The process according to claim 3, wherein the undulating recesses of the forming die have a radial section that has a substantially sinusoidal contour.

10. The process according to claim 4, wherein the undulating recesses of the forming die have a radial section that has a substantially sinusoidal contour.

11. The process according to claim 1, wherein the undulating recesses of the forming die have a radial section that has a high peak for forming a pronounced undulating contour.

12. The process according to claim 2, wherein the undulating recesses of the forming die have a radial section that has a high peak for forming a pronounced undulating contour.

13. The process according to claim 3, wherein the undulating recesses of the forming die have a radial section that has a high peak for forming a pronounced undulating contour.

14. The process according to claim 4, wherein the undulating recesses of the forming die have a radial section that has a high peak for forming a pronounced undulating contour.

15. The process according to claim 1, wherein tea undulating recesses of the forming die have a radial section that has a high peak for forming a lyre-shaped contour.

16. The process according to claim 2, wherein the undulating recesses of the forming die have a radial section that has a high peak for forming a lyre-shaped contour.

17. The process according to claim 3, wherein the undulating recesses of the forming die have a radial section that has a high peak for forming a lyre-shaped contour.

18. The process according to claim 4, wherein the undulating recesses of the forming die have a radial section that has a high peak for forming a lyre-shaped contour.

* * * * *